US008803083B2

(12) United States Patent
Goldberg

(10) Patent No.: US 8,803,083 B2
(45) Date of Patent: Aug. 12, 2014

(54) TIME OF FLIGHT MASS SPECTROMETER

(71) Applicant: Agilent Technologies, Inc., Loveland, CO (US)

(72) Inventor: Noah Goldberg, Palo Alto, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 13/683,077

(22) Filed: Nov. 21, 2012

(65) Prior Publication Data

US 2014/0138526 A1 May 22, 2014

(51) Int. Cl.
*H01J 49/26* (2006.01)

(52) U.S. Cl.
USPC ..... 250/287; 250/281; 250/282; 702/27; 702/28

(58) Field of Classification Search
USPC ..... 250/281, 282, 287; 702/22, 23, 24, 25, 702/26, 27, 28, 29, 30
See application file for complete search history.

(56) References Cited

U.S. PATENT DOCUMENTS

| | | | | |
|---|---|---|---|---|
| 5,396,065 | A | 3/1995 | Myerholtz et al. | |
| 6,300,626 | B1 | 10/2001 | Brock et al. | |
| 2005/0063864 | A1 * | 3/2005 | Sano et al. | 422/68.1 |
| 2010/0200742 | A1 * | 8/2010 | Schultz et al. | 250/252.1 |

* cited by examiner

*Primary Examiner* — Nicole Ippolito

(57) ABSTRACT

A method of determining the mass-to-charge ratios of ions in a sample is disclosed. The method includes determining a data acquisition time, where the data acquisition time is a predetermined fraction of the greatest time of flight. The method also includes providing ions from a continuous beam of a sample to a time-of-flight mass analyzer at pulse intervals having a duration equal to the predetermined fraction of the greatest flight time. The method also includes measuring a peak width and a flight time value for each of the ion species in the sample after summing the data acquired during several pulse intervals and correcting the measured flight time values according to a correlation of measured peak width values with calibration data of peak width versus flight time.

20 Claims, 5 Drawing Sheets

TIME OF FLIGHT MASS SPECTROMETER

BACKGROUND

Mass spectrometry (MS) is an analytical methodology used for quantitative elemental analysis of samples. Molecules (often referred to as analytes) in a sample are ionized and separated by a spectrometer based on their respective masses. The separated analyte ions are then detected and a mass spectrum of the sample is produced. The mass spectrum provides information about the masses and in some cases the quantities of the various analyte particles that make up the sample. In particular, mass spectrometry can be used to determine the molecular weights of molecules and molecular fragments within an analyte.

One type of mass spectrometry is time-of-flight (TOF) mass spectrometry. TOF mass spectrometry is used to form a mass spectrum for ions contained in a sample of interest. In a TOF mass spectrometer, ion packets are provided to a flight region of the instrument. The ions separate according to their mass-to-charge ratios, m/z, and their arrival times $T_i$ are recorded. According to a known TOF method, a sample is divided into packets of ions that are launched along the propagation path using a pulse-and-wait approach. In releasing packets, one concern is that the lighter and faster ions of a trailing packet will pass the heavier and slower ions of a preceding packet. Using this so-called pulse-and-wait approach, the release of an ion packet is timed to ensure that the ions of a preceding packet reach the detector before any overlap can occur. Thus, the periods between packets are relatively long. If ions are being generated continuously, only a small percentage of the ions are actually detected. A significant amount of sample material is thereby wasted. The loss in efficiency and sensitivity can be reduced by storing ions that are generated between the launching of individual packets, but the storage approach carries some disadvantages.

The inefficiencies of the known pulse-and-wait methods have led to various techniques of sending ions in pulses from a stream of ions for a sample to the detector. In one known method, the ions are pulsed using a pseudo-random pulsing sequence. Because the pulsing sequence is known, the mass spectrum can be recovered by an inverse transform. One example of pseudo-random pulsing of ions in TOF mass spectrometry applications is dithered multi-pulsing, in which a small interval is added randomly to a nominal pulse interval, Measured peaks can be assigned to their respective pulses of origin by statistical analysis, Another example is Hadamard transform TOF, in which a continuous ion beam is modulated between two detectors according to a pulse sequence typically running at 10 kHz-1 MHz. This results in a so-called 100% duty-cycle measurement. It is possible, however, to modulate the continuous ion beam "on" and "off" at a single detector with 50% duty cycle. The resulting spectrum looks like noise, but the original mass spectrum can be recovered using the inverse Hadamard transform.

While these other known methods and attendant components do provide an improvement in efficiency over the pulse-and-wait methods, they generally require additional hardware and significant data processing resources. This results in a more complex TOF MS instrument. Moreover, by these known pulsing methods, artifacts may be introduced in the process of reconstructing lost information. As such, a unique solution is not guaranteed, and several different recovered mass spectra may be consistent with the measured data, which can result in reduced instrument accuracy.

What is needed, therefore, is a method and apparatus for analyzing ions that overcomes at least the drawbacks of the known methods described above.

BRIEF DESCRIPTION OF THE DRAWINGS

The present teachings are best understood from the following detailed description when read with the accompanying drawing figures. The features are not necessarily drawn to scale. Wherever practical, like reference numerals refer to like features.

DEFINED TERMINOLOGY

Figure 1:
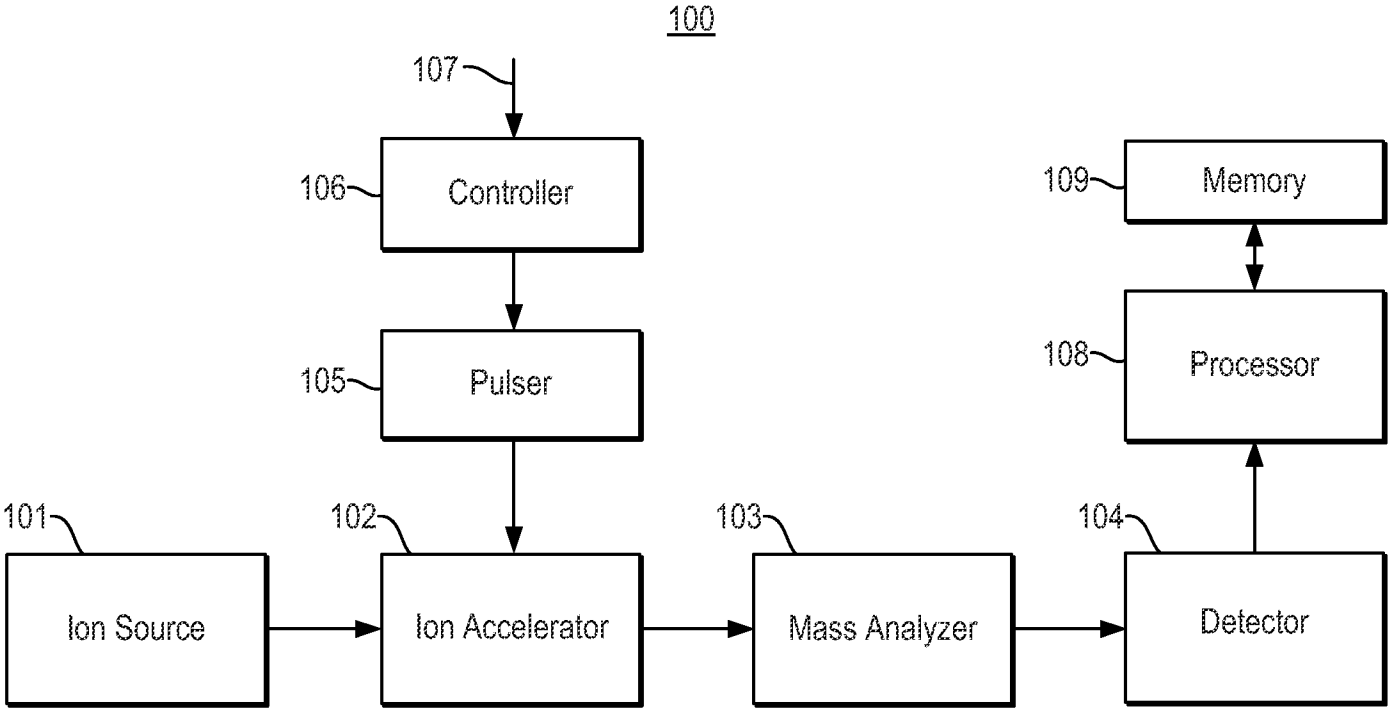
FIG. 1 shows a simplified block diagram of arm MS system in accordance with a representative embodiment.

It is to be understood that the terminology used herein is for purposes of describing particular embodiments only, and is not intended to be limiting. The defined terms are in addition to the technical and scientific meanings of the defined terms as commonly understood and accepted in the technical field of the present teachings.

As used in the specification and appended claims, the terms 'a', 'an' and 'the' include both singular and plural referents, unless the context clearly dictates otherwise. Thus, for example, 'a device' includes one device and plural devices.

As used in the specification and appended claims, and in addition to their ordinary meanings, the terms 'substantial' or 'substantially' mean to with acceptable limits or degree. For example, 'substantially cancelled' means that one skilled in the art would consider the cancellation to be acceptable.

As used in the specification and the appended claims and in addition to its ordinary meaning, the term 'approximately' means to within an acceptable limit or amount to one having ordinary skill in the art. For example, 'approximately the same' means that one of ordinary skill in the art would consider the items being compared to be the same.

DETAILED DESCRIPTION

In the following detailed description, for purposes of explanation and not limitation, representative embodiments disclosing specific details are set forth in order to provide a thorough understanding of the present teachings. Descriptions of known systems, devices, materials, methods of operation and methods of manufacture may be omitted so as to avoid obscuring the description of the example embodiments. Nonetheless, systems, devices, materials and methods that are within the purview of one of ordinary skill in the art may be used in accordance with the representative embodiments.

In accordance with representative embodiments described in more detail below, a method of determining the mass-to-charge (m/z) ratios of ions in a sample is disclosed. The method comprises providing a calibration sample comprising ions of differing m/z ratios to a TOF mass analyzer. The ion species in the calibration sample typically span a range of m/z ratios similar to what may be expected to be present within an unknown sample to be analyzed. The calibration data may also be extrapolated to allow measurements of unknown samples over a wider m/z range. The calibration sample often comprises chemical species chosen for long shelf life, low fragmentation during the mass spectrometer measurement, or other desirable characteristics. Moreover, the calibration sample may comprise molecules chosen to have properties similar to the molecules in the unknown sample (for example, similar collision cross sections as a function of m/z). Data from the calibration sample are acquired until an ion of the calibration sample having a greatest time of flight is incident on the detector. A peak width is determined for each of the ion species of the calibration sample after several TOF measurements of the calibration sample are summed, to provide calibration data of the peak width versus flight time for the calibration sample. Next, a data acquisition time is determined. As described more fully below, the data acquisition time is a fraction of the greatest time of flight. After determining the data acquisition time, ions from a continuous ion beam of a sample are provided to the TOF mass analyzer at pulse intervals having a duration equal to the predetermined fraction of the greatest time of flight. Next, a peak width and a flight time value are determined for each of the ion species in the sample after summing the data acquired during several pulse intervals. Notably, a scaled background spectrum of known contaminant ions may optionally be subtracted before determining the peak width values of the ion species in the sample. The measured flight time values are corrected by correlating the measured peak width values with the calibration data of peak width versus flight time, and the corrected flight time values are converted into the m/z ratios. As described below, the present teachings contemplate instantiation of the method in a non-transitory computer-readable medium, or in hardware, or in firmware, or a combination thereof.

FIG. 1 shows a simplified schematic block diagram of a mass spectrometer 100 in accordance with a representative embodiment. The block diagram is drawn in a more general format because the present teachings may be applied to a variety of different types of mass spectrometers. As should be appreciated as the present description continues, devices and methods of representative embodiments described herein may be used in connection with the mass spectrometer 100. As such, the mass spectrometer 100 is useful in garnering a more comprehensive understanding of the functions and applications of the apparatuses and methods of the representative embodiments, but is not intended to be limiting of these functions and applications.

The mass spectrometer 100 is generally a TOF mass spectrometer and comprises an ion source 101, an ion accelerator 102, a mass analyzer 103 and a detector 104. The mass spectrometer 100 also comprises an ion pulser ("pulser") 105 coupled to the ion accelerator 102. Pulsed voltages are applied in the pulser 105, and ions are pulsed from the ion accelerator 102 to the mass analyzer 103 at desired pulse intervals, as described more fully below. The mass analyzer 103 is a TOF mass analyzer. The ion source 101, ion accelerator 102, mass analyzer 103 and detector 104 are known components used in TOE mass spectrometry. For example, many of the components of the mass spectrometer 100 are provided in instruments commercially available from Agilent Technologies, Inc. Santa Clara, Calif. (USA). As such, many of the details of these known components are not presented herein to avoid obscuring the description of representative embodiments.

The mass spectrometer 100 also comprises a controller 106 that receives an input 107 and commands from the controller 106, and drives the output of the pulser 105. Ultimately, the controller 106 sets the duration and frequency of ion pulses provided to the mass analyzer 103 and detector 104 according to aspects of the methods of representative embodiments. The controller 106 may be a dedicated component, or the controller of the instrument embodying the mass spectrometer.

The mass spectrometer 100 also comprises a processor 108 and a memory 109. The processor 108 is configured to determine the m/z ratios according to the methods of representative embodiments described below. The processor 108 may be implemented using a processing device, such as processor/microprocessor, a digital signal processor (DSP), one or more application specific integrated circuits (ASICs), one or more field-programmable gate arrays (FPGAs), or combinations thereof, using software, firmware, hard-wired logic circuits, or combinations thereof. When using a computer processor and/or a DSP, for example, the memory 109 stores executable software/firmware and/or executable code that allows the processor 108 to perform the various functions of the methods of the representative embodiments. The memory 109 may be a non-transitory computer readable medium, and may include any number, type and combination of random access memory (RAM) and non-volatile memory (e.g., read-only memory (ROM)), for example. Finally, it is contemplated that the controller 106 and the processor 108 are a single component associated with memory 109. This single component could be a dedicated processor of the instrument that embodies the mass spectrometer 100. As will become clearer as the description continues, input 107 to the controller 106 can be provided from the processor 108 and memory 109. Accordingly, a single component configured to implement the methods of the representative embodiments is contemplated.

As ion packets travel through the TOF mass spectrometer, their arrival time at the detector varies according to mass. Moreover, the longer the time ions spend in the instrument, the greater the spread in arrival times for ions of the same mass becomes. The measured peak width (defined as full-width at half maximum (FWHM)) for an ion species is given by $\Delta T_i$. Generally, a given ion species in a TOF experiment $\Delta T_i$ can be represented by:

$$\Delta T=(\Delta T_0^2+\Delta T_m^2)^{1/2}$$

where $\Delta T_0$ is a fixed peak broadening term, and $\Delta T_m$ is a peak broadening term that is proportional to the mass of the ion. $\Delta T_0$ can be impacted by factors such as the detector impulse response width and jitter in the timing of the high voltage pulse that launches the ion packet, as well as timing errors in the data acquisition system. $\Delta T_m$ comprises mass dependent aberrations including imperfect alignment of the ion optics, mechanical vibrations, turn-around time arising from the initial velocity spread of the ions, power supply noise, collisions with gas molecules in the high vacuum region, etc. For small mass-to charge ratios, m/z, the pulse width is limited by the impulse response of the detector, $\Delta T_0$. Generally, each mass spectrometer will have a characteristic curve for the peak width versus time of arrival. Once this relationship is determined, it can be used as a calibration curve in accordance with the methods of the representative embodiments described below. According to one aspect of the method the calibration curve for a given instrument can be determined by measurements of $\Delta T$ versus time of arrival at the detector by multiple pulse-and-wait measurements. Moreover, once the calibration curve is determined, it can be interpolated and extrapolated to determine $\Delta T$ for ion peaks not specifically determined through the calibration.

Figure 2:
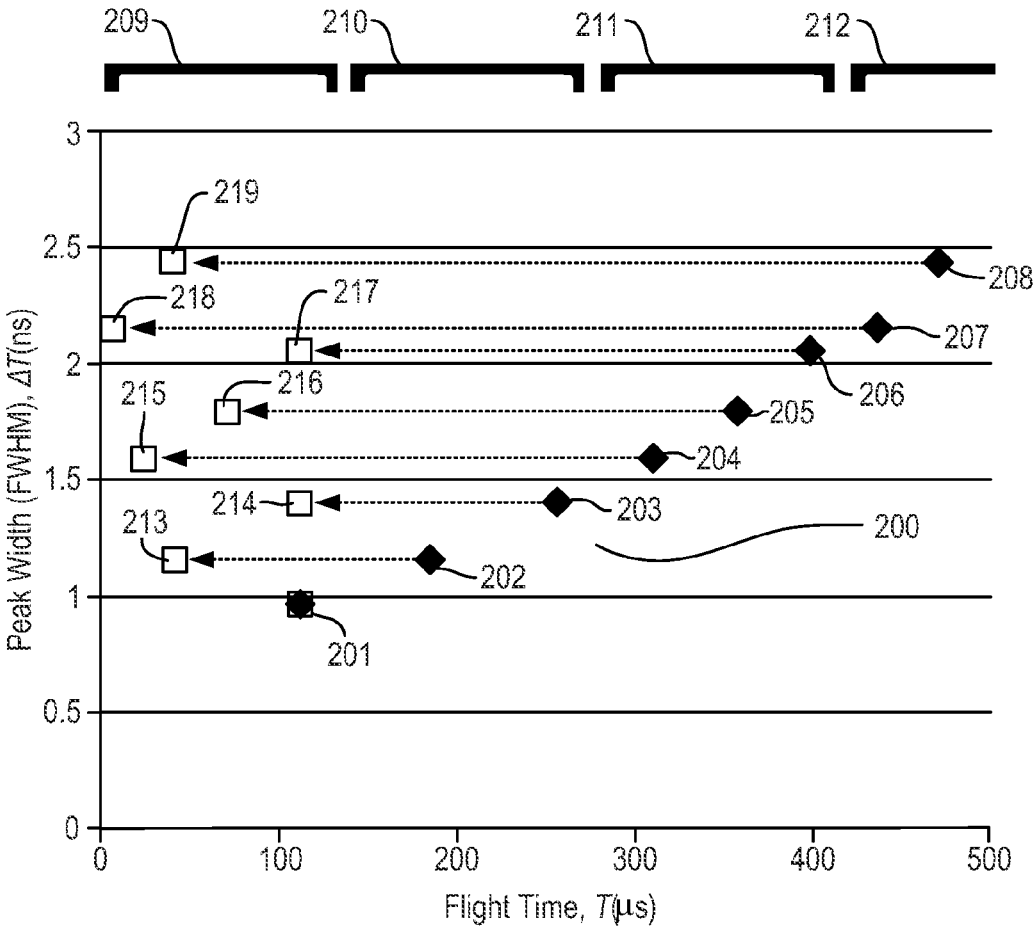
FIG. 2 is a graphical representation of time of flight versus peak width useful in illustrating a method in accordance with a representative embodiment.

FIG. 2 is a graphical representation of time of flight versus peak width useful in illustrating a method in accordance with a representative embodiment. As described below, a calibration curve is determined; and information of the peak width response of the TOF mass spectrometer enables assignment of peaks in an overlapped mass spectrum.

In accordance with a representative embodiment, the ions are provided by the ion accelerator 102 in a pulsed manner to the mass analyzer 103 at a fixed repetition rate based on the ion of the sample having the greatest time of flight. Notably, the fixed repetition rate is merely illustrative, and as described below, the pulse interval is otherwise set. In the present illustration, the greatest time of flight of an ion in the calibration sample to reach the detector is 469 as (m/z 2122). It is contemplated that the unknown sample may contain ions with higher m/z species than the calibration sample. In the present illustration, it is desired to measure unknown samples potentially containing ions with m/z≤3150. Consequently, the greatest time of flight in the sample (572 μs) is longer than the greatest time of flight of a calibration ion. Furthermore, for certain samples, the greatest time of flight of an ion in the sample may be shorter than the greatest time of flight of the calibration data. Instruments in accordance with the present teachings typically offer comparatively high and comparatively low mass ranges (e.g. 3200 amu and 1700 amu, respectively) for liquid chromatography, and mass ranges in gas chromatography can be even lower. As such, it can be beneficial to use a single calibrant mixture that covers the widest mass range needed rather than maintain separate calibrants.

The pulser 105 is configured to command the ion accelerator 102 to provide pulses of ions from a stream of ions from the ion source 101 at a rate that is a fraction of the greatest time of flight. Continuing with this illustration, the ion accelerator 102 provides ions to the mass analyzer 103 (and ultimately to the detector 104) at an interval that is approximately one-fourth the greatest time of flight of the unknown sample or every 143 μs. As such, the mass spectrometer 100 is configured to provide ions at a rate that is four times faster than would be allowed for a known pulse-and-wait or non-interleaved mass spectrometer measurement of m/z≤3150.

As described more fully below, ion arrival events arising from several consecutive pulses are assigned to an appropriate flight time based on their measured peak widths after the data from multiple pulses are summed at the processor 108 to provide a spectrum. Beneficially, the present teachings make use of information present in the overlapped mass spectrum when summed over multiple transients. As such, a greater number of ions (in this example four times as many) are provided to the detector 104 than would be provided in the known pulse-and-wait or non-interleaved TOF instrument. It is emphasized that the pulse rate/frame period described above is merely illustrative, and other pulse rates/frame periods are contemplated according to the present teachings.

Returning to FIG. 2, calibration curve 200 comprises calibration data points 201~208 in the present representative embodiment. Notably, the calibration sample comprises ions of different mass-to-charge ratios and each of the calibration data points 201~208 is a peak width/flight time combination representative of one of the ion species in the calibration sample. The data from the calibration sample may be determined by repeating a pulse-and-wait measurement in the conventional manner, or at a faster pulsing rate as long as the aliased arrival times of the calibrant species are already known. The calibration data will typically be acquired in the same way as an unknown sample (acquiring summed spectra at about ~1 Hz, but potentially at a few Hz or faster). As long as the TOF mass spectrometer 100 is performing near its specification repeating the calibration run is normally not necessary, although the calibration may be different for certain samples. For example, comparatively large molecules such as intact proteins that have a different mass-dependent broadening because of an increased number of collisions inside the mass analyzer may require a different calibration. Nonetheless quadrupole TOF (QTOF) instruments contemplated for use in connection with the present teachings typically are equipped with a calibrant delivery system and the user might do an autotune at regular intervals (e.g., daily or weekly), so these autotune results can easily be used to periodically check the calibration.

As noted above, the sample used to provide the calibration data can be a sample with known chemical species, or may be an unknown sample, such as a portion of the actual sample to be analyzed. As noted above, calibration will be routinely checked with the standard calibration sample (tuning mix). In the case that calibration fails (e.g., due to the presence of large intact proteins, where $\Delta T_m$ is larger than it is in the tuning mix data), some of the unknown sample data can be used to self-calibrate in a crude way. Specifically, the measured (aliased) spectrum can be reviewed from shortest time of flight to greatest time of flight (i.e., left to right on the ordinate of FIG. 2), with the expectation that the peaks should get broader with increasing time of flight. If, however, a peak is found with a longer flight time and a narrower pulse width compared to its neighbor, then it is possible that the two peaks belong to different pulse frames.

After the calibration data are acquired, a new pulsing interval equal to a fraction of the greatest time of flight is determined, as will be described later. In the present illustration, the fraction is one-fourth of the greatest time of flight, or 143 μs. This value represents the data acquisition time for TOF mass spectrometer 100. As such, the ion accelerator 102 provides a packet of ions every 143 μs, and peak width/flight time data are acquired for an unknown sample. The difference between the true and aliased arrival times (the length of the arrows between calibration data points 201~208 and data points 213~219) is exactly a multiple of the 143 μs pulsing interval. First through fourth frames 209~212 are depicted, and are useful in the explanation of method of representative embodiments.

After the calibration curve 200 is determined, multi-pulsing begins at the selected pulse rate, which in this case is 143 μs. Data points 213~219 are acquired over the data acquisition time (four frames), which in this example is 572 μs. Notably, FIG. 2 depicts four consecutive frames from a much longer series of frames. Data from only the sample ions launched at T=0 μs are shown. Some of these sample ions are detected during each of the four frames, but because the data acquisition system resets the time to zero at the beginning of each frame, the peaks are all recorded with arrival times between 0 μs-143 μs. In a pulse-and-wait measurement, each peak would arrive once. Because four packets are launched, each peak arrives four times, in four frames, at the same measured arrival time because the clock is reset to "zero." If the peak heights were plotted, the multi-pulsed data peak heights (corresponding to data points 213~219) would be four times "taller" than the peak heights of the data acquired in a pulse-and-wait mode (corresponding to calibration data points 201~208).

Note that FIG. 2 shows how the flight times change when measuring the calibration sample in either pulse-and-wait mode (corresponding to calibration data points 201~208) or multi-pulsed mode (corresponding to data points 213~219). In other words, for ease of description, the unknown sample was chosen to be identical to the calibration sample for clarity in showing the relationship of the aliased flight times to the true flight times. In a truly unknown sample, the arrows would point from a curve fit of the calibration data instead of pointing directly from calibration data points 201~208. Because the pulse interval is a fraction of the total acquisition time, data points 213~219 are initially depicted in the first frame 209, and must be correlated or assigned to one of the respective calibration data points 201~208. Notably, calibration data point 201, which represents the first data point of both the measured data and calibration data, occurs at a flight time of approximately 100 μs. Stated somewhat differently, the earliest time of arrival of the ion with the smallest m/z in a pulse is 100 μs, and its peak width is approximately 1 ns. So, if a peak width (ΔT) less than 1 ns is measured, this constrains the pulse of origin to have occurred within approximately 100 μs. If the peak belonged to the preceding pulse then the true flight time would be 143 μs longer than the measured flight time, and the peak width would be expected to be greater than 1 ns. This relation breaks down for extremely low abundance peaks, for example if only a single impulse-response-limited ion is observed, or when the uncertainty in the width measurement is worse than the precision required to distinguish between neighboring pulser firings. For example, a high dynamic range spectrum may contain peaks having shapes that depend on abundance because of saturation. In this case, the measured width is not the true width because of artifacts in the data (e.g. a peak may look flat-topped instead of being approximately Gaussian in shape); furthermore, the presence of such an artifact is a clear indication that the measured peak width is incorrect. Small abundance-width errors may be corrected by calibration, but extreme detector saturation could result in incorrect assignments. Other sources of error or noise, including those that contribute to $\Delta T_m$, may similarly cause a reduction in the precision or accuracy of the peak width measurements.

Data point 213 has a measured flight time of approximately 40 μs and a peak width of approximately 1.1 ns. However, as noted above, no ion from a first pulser firing could have reached the detector 104 in only 40 μs and have a peak width greater than that of calibration data, point 201. So, data point 213 must have been a slower moving ion from a pulse prior to the pulse at T=0 μs. As such, one or more frame lengths must be added to data point 213 to determine its actual arrival time for the measured peak width. Notably, the data point 213 has the same peak width as data point 202 and maps to this point (data point 202) on the calibration curve 200. As such, according to the present teachings data point 213 is determined to have a peak width of 1.1 ns and a flight time to the detector of approximately 40 μs plus one frame period (143 μs) or 183 μs. As such, it is determined that the data point 213 is from first frame 209, but arrives in frame 210.

Data point 214 has a measured peak width of approximately 1.4 ns and a flight time of approximately 100 μs. As noted above, the minimum peak width for the sample under measurement is approximately 1 ns (calibration data point 201). As such, the measured flight time of data point 214 cannot be its actual flight time, and data point 214 represents the peak width of an ion from an earlier pulse frame. Mapping data point 214 to the calibration curve 200 reveals its true flight time is approximately 240 μs. So, by adding one frame period to data point 214 the actual arrival time of an ion having a peak width of approximately 1.4 ns (data point 203) is determined. As such, it is determined that the data point 214 is from first frame 209, but arrives in frame 210.

Data point 215 has a peak width of approximately 1.6 ns and measured arrival time of approximately 20 μs. Again, the minimum peak width for the sample under measurement is approximately 1 ns (calibration data point 201), so the measured flight time cannot be the actual flight time and data point 215 represents the peak width of an ion from an earlier pulse frame. However, if one frame period is added, there is no corresponding data point on the calibration curve 200, so another frame period must be added. By adding two frame periods, an ion with peak width of approximately 1.6 ns (data point 204) is found on the calibration curve 200. Mapping data point 215 to the calibration curve 200 reveals its true flight time is approximately 310 μs. So, by adding two frame periods to data point 215 the actual arrival time of an ion having a peak width of approximately 1.6 ns is determined. As such, it is determined that the data point 215 is from first frame 209, but arrives in frame 211.

Data point 216 has a peak width of approximately 1.8 ns and measured arrival time of approximately 70 μs. Again, the minimum peak width for the sample under measurement is approximately 1 ns (calibration data point 201), so the measured flight time cannot be the actual flight time and data point 216 represents the peak width of an ion from an earlier pulse frame. However, if one frame period is added, there is no corresponding data point on the calibration curve 200, so another frame period must be added. By adding two frame periods, an ion with peak width of approximately 1.8 ns (calibration data point 205) is found on the calibration curve 200. Mapping data point 216 to the calibration curve 200 reveals its true flight time is approximately 360 μs. So, by adding two frame periods to data point 216 the actual arrival time of an ion having a peak width of approximately 1.8 ns is determined. As such, it is determined that the data point 216 is from first frame 209, but arrives in frame 211.

Data point 217 has a peak width of approximately 2.1 ns and measured arrival time of approximately 100 μs. Again, the minimum peak width for the sample under measurement is approximately 1 ns (calibration data point 201), so the measured flight time cannot be the actual flight time and data point 217 represents the peak width of an ion from an earlier pulse frame. However, if one frame period is added, there is no corresponding data point on the calibration curve 200, so another frame period must be added. By adding two frame periods, an ion with peak width of approximately 2.1 ns is found (data point 206) on calibration curve 200.

Mapping data point 217 to the calibration curve 200 reveals its true flight time is approximately 390 μs. So, by adding two frame periods to data point 217 the actual arrival time of an ion having a peak width of approximately 2.1 ns is determined. As such, it is determined that the data point 217 is from first frame 209, but arrives in frame 211.

Data point 218 has a peak width of approximately 2.2 ns and measured arrival time of approximately 0 μs. Plainly, an ion with a peak width greater than $\Delta T_0$ could not arrive at the detector almost instantaneously after firing from the ion accelerator 102. Again, the minimum peak width for the sample under measurement is approximately 1 ns (calibration data point 201), so the measured flight time cannot be the actual flight time and data point 218 represents the peak width of an ion from an earlier pulse frame. However, if one or two frame periods are added, there is no corresponding data point on the calibration curve 200, so another frame period must be added. By adding three frame periods, an ion with peak width of approximately 2.2 ns is found (data point 207) on calibration curve 200. Mapping data point 218 to the calibration curve 200 reveals its true flight time is approximately 430 μs. So, by adding three frame periods to data point 218 the actual arrival time of an ion having a peak width of approximately 2.2 ns is determined. As such, it is determined that the data point 218 is from first frame 209, but arrives in frame 212.

Data point 219 has a peak width of approximately 2.4 ns and measured arrival time of approximately 40 μs. Again, the minimum peak width for the sample under measurement is approximately 1 ns (calibration data point 201), so the measured flight time cannot be the actual flight time and data point 219 represents the peak width of an ion from an earlier pulse frame. However, if one or two frame periods are added, there is no corresponding data point on the calibration curve 200, so another frame period must be added. By adding three frame periods, an ion with peak width of approximately 2.4 ns is found (data point 208) on calibration curve 200. Mapping data point 219 to the calibration curve 200 reveals its true flight time is approximately 470 μs. So, by adding three frame periods to data point 218 the actual arrival time of an ion having a peak width of approximately 2.2 ns is determined. As such, it is determined that the data point 219 is from first frame 209, but arrives in frame 212.

While the description of the determination of actual flight times of data points 213~219 of FIG. 2 is illustrative of the process, a more general description can be provided.

Generally, after a calibration curve is determined, an observed flight time $T_{obs}$ and a peak width $\Delta T_{obs}$ are determined. If $\Delta T_{obs}$ is greater than the peak width $\Delta T_{cal}$ of a calibration data point with a flight time equal to the observed flight time of the unidentified ion, a data acquisition interval $T_{acq}$ (equal to a frame period) is added repeatedly until the $\Delta T_{obs}$ is approximately equal to the $\Delta T_{cal}$ and a new peak identification is recorded. The process continues until all peaks have been recorded that have heights above a threshold which corresponds to having enough ions within the peak in order to measure an accurate peak width. For, as mentioned above, a peak containing only a single ion will have the same width as the detector impulse response; in general, to obtain an accurate peak width for an ion species, it is necessary to continue summing data until several ions are present in the peak.

When low-abundance ion species in the unknown sample give rise to peaks below the height threshold described above, it is still possible in some cases to assign these peaks correctly based on criteria other than peak width. Some of these alternative criteria are described below.

As alluded to previously, data points 201, 213~219 are acquired over a large number of pulses of ions sent through the mass spectrometer. Beneficially, the data, acquired contain many times (in this case four times) the amount of analyte signals that can be acquired using the known pulse-and-wait TOF measurements in the same measurement period. In the case of sparse spectra containing few peaks, the increase in the measured signal may be 10×-20× higher than the pulse-and-wait approach (and frame periods correspondingly lower) without causing the determination of peak widths to fail due to overlapping peaks. The present teachings can thus be beneficially applied in combination with gas or liquid chromatography or other techniques that spread out the arrivals of the ion species over a separation time. The present teachings may also be beneficially applied to high resolution TOF-MS because with higher resolving power it is possible to simultaneously measure a greater number of closely spaced peaks without overlaps.

The method of the representative embodiment described in connection with FIG. 2 is illustrative of a technique for determining the actual flight times (or actual arrival times) of ions in a multi-pulsed TOF MS experiment. As noted above, the method comprises sending pulses at a fraction of the greatest time of flight of the calibration sample or the greatest time of flight anticipated to be present in an unknown sample (which may be longer or shorter than the greatest time of flight of the calibration sample). In this illustrative example, first through fourth frames 209-212 have a period of ¼ the greatest time of flight. However, this is merely illustrative, and smaller and greater fractions of the greatest time of flight are contemplated. Notably, the greater the number of pulses per greatest time of flight, hereafter referred to as the multi-pulsing factor, (the smaller the frame period), the greater the amount of analyte signal can be obtained. However, there is a limit to the scaling of the frame periods/number of frames per greatest time of flight. The lower limit of the multi-pulsing factor is 1× and corresponds to a conventional pulse-and-wait measurement. The upper limit is set by the time it takes for the continuous beam of the sample to refill the ion accelerator after a packet of ions is launched. If the ion pulser 102 is fired at intervals equal to the refilling time, then 100% of the ions from the continuous ion beam will be sent into the mass analyzer 103, and pulsing at a faster rate will not increase the number of ions detected. The useful range of the multi-pulsing factor in order to receive the benefits of the present teachings is typically between 2×-10× and depends on the sample and the instrument configuration. One way to set the pulsing rate is to infuse a sample and measure the spectrum at several different pulsing rates, including the normal pulse-and-wait interval (1×) as a reference. The chosen pulsing rate is the fastest rate that allows identification of all of the reference peaks. Background subtraction of known contaminant ions may optionally be performed before determining peak widths in order to increase the number of peaks correctly identified; and a comparatively high multi-pulsing factor may also result in the identification of new peaks that were previously too small to see in the reference spectrum. A fixed multi-pulsing factor may be chosen for the entire duration of an experiment, or the multi-pulsing factor may be set adaptively (e.g. pulsing at a higher rate during the elution times of well separated chromatographic peaks, and decreasing the pulsing rate during coeluting chromatographic peaks).

Figure 3:
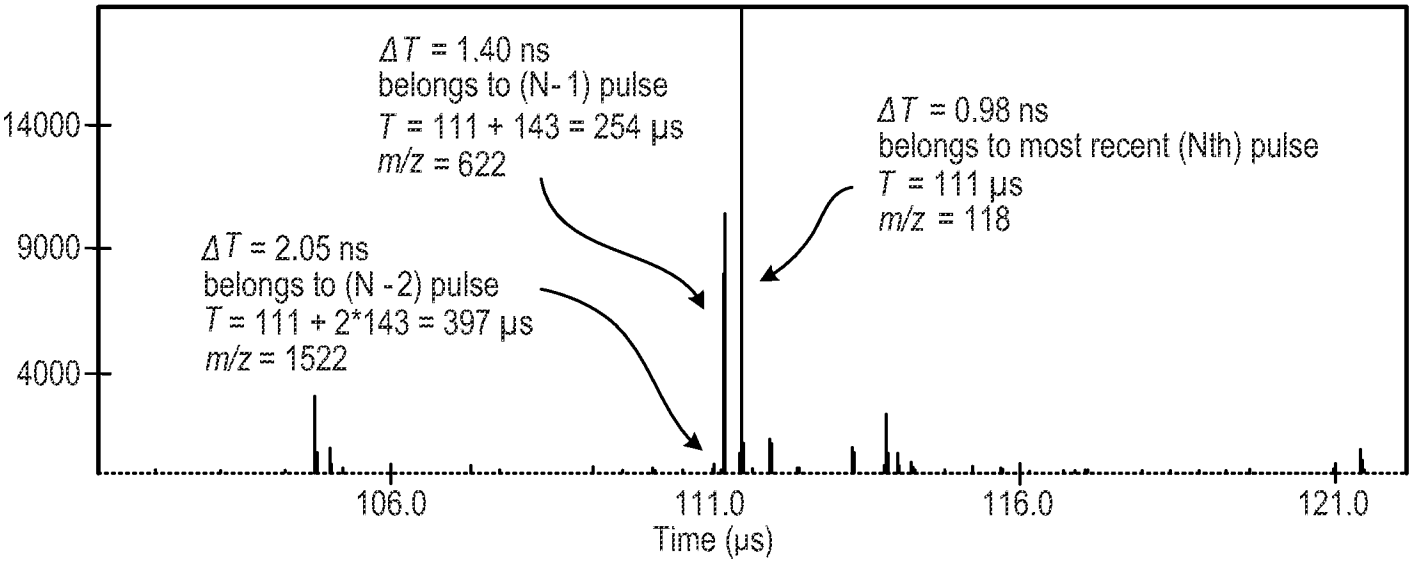
FIG. 3 depicts spectral data resolved by a method in accordance with a representative embodiment.

FIG. 3 depicts spectral data resolved by a method in accordance with a representative embodiment. Specifically, FIG. 3 presents the measured flight time versus mass-to-charge ratio for a particular sample provided to the TOF mass spectrometer 100 in interleaved pulses according to the present teachings. Notably, for ease of description, the spectral data of FIG. 3 were acquired using calibration data and frame periods that are the same as those described in connection with the embodiments of FIG. 1. As can be appreciated, the three peaks indicated in FIG. 3 have a measured flight time of approximately 111 μs, and different peak widths. The first peak has a width of approximately 2.05 ns. The second peak has a width of approximately 1.40 ns, and the third peak has a width of 0.98 ns. Following the method presented in connection with FIG. 2, the third peak correlates to the most recent pulse, the second peak correlates to the next earlier pulse and the first peak correlates to two previous pulses. So, by the present teachings, the data points of the spectrum depicted in FIG. 3 are readily correlated to the calibration data. As such, the width of each peak is compared with calibration data to constrain the possible arrival times and an integer number of pulser firing intervals is added to the measured flight time before calculating m/z.

Other constraints can be used in the determining of m/z ratios of ions in a sample according to the present teachings. These constraints may be particularly useful in cases where the peak width cannot be correctly determined (for example, peaks comprising only a single ion or very few ions). If the ion source 101 is configured to provide only a limited range of m/z ions, then any flight time corresponding to a m/z ratio outside the transmission window may be rejected. For example, the quadrupole in a QTOF instrument might be configured with a low mass cutoff that rejects ions with m/z<50, thus allowing the determination that an ion with an early measured flight time cannot belong to the packet launched at time T=0 μs. Furthermore, in FIG. 2, setting a low mass cutoff to reject ions with m/z<200 ensures that no ions can arrive during the first acquisition frame 209. Similarly, a high-pass, low-pass or band-pass filter may be used to restrict the range of measured ions to particular frames.

Figure 4:
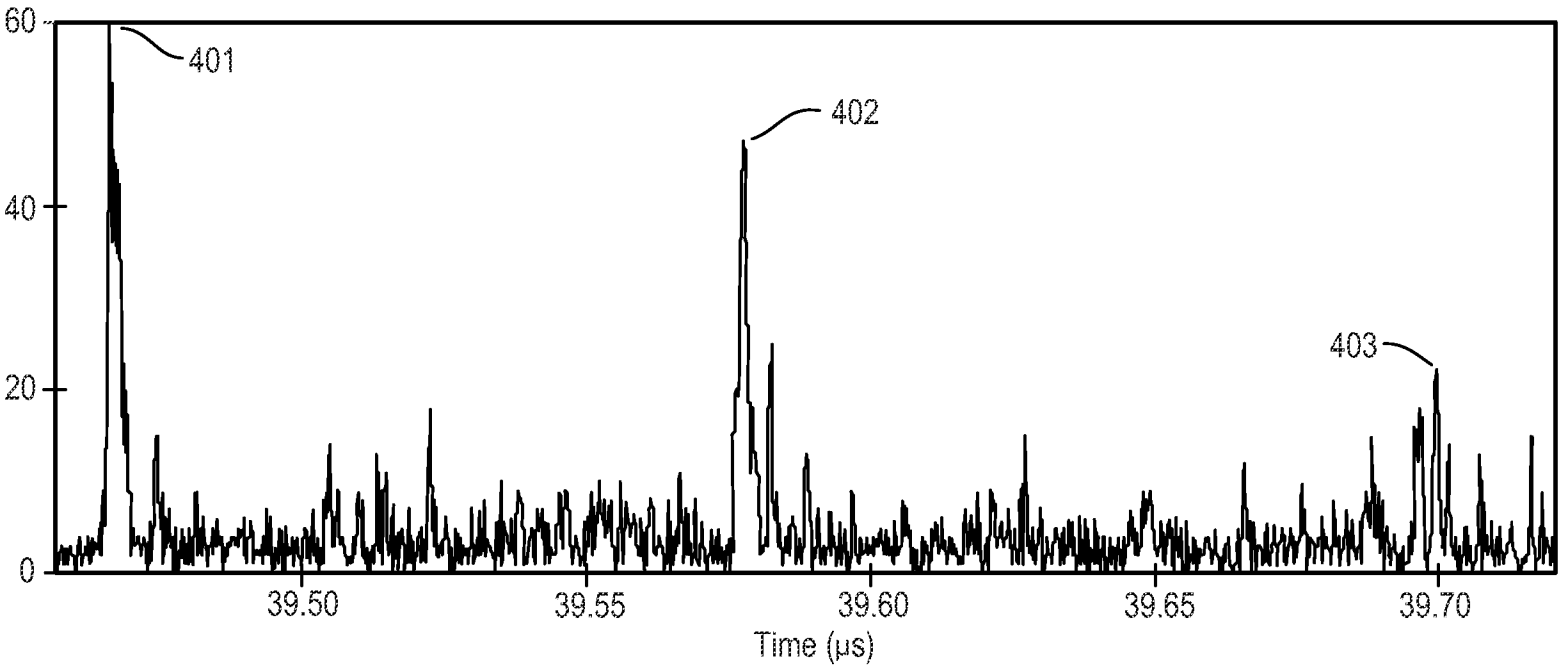
FIG. 4 depicts spectral data of isotopic peaks of a sample resolved in accordance with a representative embodiment.

An example of using isotopic peaks as an additional constraint is shown in FIG. 4. FIG. 4 depicts flight time versus abundance (arbitrary units) for several peaks with heights near the limit of detection. First peak [M] 401 has a pulse width of approximately 2.4 ns and its height is just above the threshold at which its width can be accurately measured. The height of the second peak 402 is just below the threshold, and its width is incorrectly determined to be 1.4 ns. The third peak 403 represents a single ion and its measured width of 0.9 ns is the same as the detector impulse response. Because the height of the first peak 401 is above the threshold, it can be assigned to m/z 2122 arising from the N−3 pulse; the remaining peaks are below the threshold and cannot be assigned by their measured widths. If the first and second peaks 401, 402 are both taken to originate from the N−3 pulse, then the separation is 1 amu, corresponding to first [M] peak 401 and the second [M+1] peak 402. Other choices such as the N or N−1 pulse do not imply any known chemical relationship between peaks. The more peaks that are visible in a related series, the less likely they are to have arisen by chance: the interpretation that gives the highest number of isotopic correlations is likely to be the correct assignment. In fact, the correct assignment for peaks 401, 402, 403 is m/z 12122, 2123, 2124 corresponding to a series of related isotopic peaks for a single chemical compound. A more sophisticated application of this technique could take into account more complex isotope patterns, including peaks arising from, for example, $^{13}C$, $^{34}S$, $^{37}Cl$ or other commonly occurring isotopes of chemical elements. These isotopic peak patterns may be further correlated with the results of a computer program that generates possible molecular formulas given the measured m/z ratio of a peak. Chemical adducts may also beneficially give rise to related peaks, such as the [M+H] or [M+Na] peaks that are often observed in electrospray ionization or other ionization sources based on chemical ionization. Furthermore, peak height ratios may be used as an additional constraint. For example, if an [M] peak and an [M+2] peak are observed with a height ratio of 3:1, this correlation will be highly favorable if the molecular formula contains a Cl atom, and less favorable if the molecule is known not to contain Cl. Peaks may also be correlated using patterns arising from molecules which are present in the sample in multiple charge states, for example $[M+H]^+$ and $[M+2H]^{2+}$.

Figure 5:
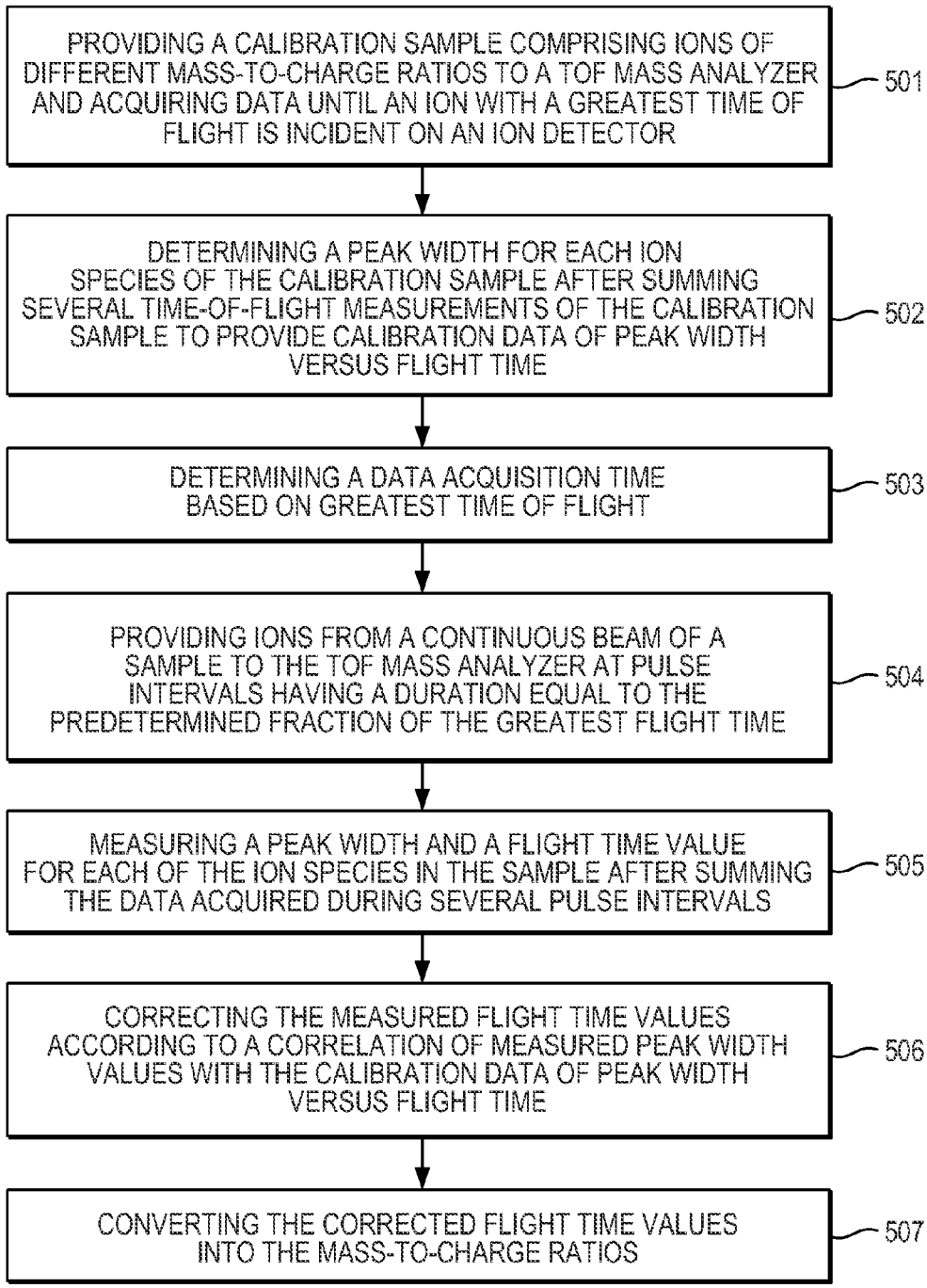
FIG. 5 is a flow chart of a method of determining mass-to-charge ratios of ions in accordance with a representative embodiment.

FIG. 5 is a flow chart of a method 500 of determining mass-to-charge ratios of ions in accordance with a representative embodiment. Many details of the method described in connection with FIG. 4 are presented in the description of representative embodiments above. As such, details are not necessarily repeated to avoid obscuring the description of the illustrative method. Moreover, it is emphasized that the method can be implemented in mass spectrometer 100 in software, hardware or firmware, or combinations thereof The method 500 is a method for determining the mass-to-charge ratios of ions in a sample.

At 501, the method comprises providing a calibration sample comprising ions of different mass-to-charge ratios to a time-of-flight mass analyzer and acquiring data until an ion with a greatest time of flight is incident on an ion detector.

At 502, the method comprises determining a peak width for each ion species of the calibration sample after summing several time-of-flight measurements of the calibration sample to provide calibration data of peak width versus flight time.

At 503, the method comprises determining a data acquisition time, the data acquisition time being a predetermined fraction of the greatest time of flight.

At 504, the method comprises providing ions from a continuous beam of a sample to a time-of-flight mass analyzer at pulse intervals having a duration equal to the predetermined fraction of the greatest flight time.

At 505, the method comprises measuring a peak width and a flight time value for each of the ion species in the sample after summing the data acquired during several pulse intervals.

At 506 the method comprises correcting the measured flight time values according to a correlation of measured peak width values with the calibration data of peak width versus flight time.

At 507 the method comprises converting the corrected flight time values into the mass-to-charge ratios.

In view of this disclosure it is noted that the methods and devices can be implemented in keeping with the present teachings. Further, the various components, materials, structures and parameters are included by way of illustration and example only and not in any limiting sense. In view of this disclosure, the present teachings can be implemented in other applications and components, materials, structures and equipment needed to implement these applications can be determined, while remaining within the scope of the appended claims.

The invention claimed is:

1. A method of determining the mass-to-charge ratios of ions in a sample, the method comprising:

providing a calibration sample comprising ions of different mass-to-charge ratios to a time-of-flight mass analyzer and acquiring data until an ion with a greatest time of flight is incident on an ion detector;

determining a peak width for each ion species of the calibration sample after summing several time-of-flight measurements of the calibration sample to provide calibration data of peak width versus flight time;

determining a data acquisition time, the data acquisition time being a predetermined fraction of the greatest time of flight;

providing ions from a continuous beam of a sample to a time-of-flight mass analyzer at pulse intervals having a duration equal to the predetermined fraction of the greatest flight time;

measuring a peak width and a flight time value for each of the ion species in the sample after summing the data acquired during several pulse intervals;

correcting the measured flight time values according to a correlation of measured peak width values with the calibration data of peak width versus flight time; and converting the corrected flight time values into the mass-to-charge ratios.

2. A method as claimed in claim 1, further comprising interpolating calibration data between the flight times of the ion species in the calibration sample to determine approximate peak widths at flight times that were not measured in the calibration data, and comparing at least one of the measured peak widths from the sample data to a corresponding one of the interpolated peak widths from the calibration data.

3. A method as claimed in claim 1, further comprising extrapolating calibration data beyond the ions with the greatest and the smallest times of flight, and comparing at least one of the measured peak widths from the sample data to a corresponding one of the extrapolated peak widths from the calibration data.

4. A method as claimed in claim 1, wherein the providing of the ions is repeated over a data acquisition interval.

5. A method as claimed in claim 1, wherein the determining of the data acquisition time further comprises reducing the time interval between pulses until an uncertainty in a peak width measurement is greater than a precision required to distinguish between peak widths from the calibration data for flight times that differ by the pulsing interval.

6. A method as claimed in claim 1, wherein the determining of the data acquisition time further comprises:

providing a reference sample to acquire reference peaks; and reducing the duration of the pulse intervals until one or more of the reference peaks present cannot be identified due to overlapping peaks in a spectrum measured with the reduced duration.

7. A method as claimed in claim 6, wherein at least two overlapping peaks are not contaminant peaks present in the background spectrum.

8. A method as claimed in claim 7, further comprising after identifying overlapping peaks, increasing the pulse intervals until the peaks are resolved.

9. A method as claimed in claim 1, further comprising:

measuring a background spectrum having peaks;

scaling the peaks of the background spectrum; and subtracting the scaled peaks from the sample data before the peak widths are determined.

10. A method as claimed in claim 9, wherein at least one of the scaled peaks of the background spectrum is a peak from a known contaminant that overlaps a peak from an unknown ion species.

11. A time-of-flight (TOF) mass spectrometer (MS) comprising a processor configured to perform the method of claim 1.

12. A TOF MS as claimed in claim 11, wherein the processor comprises hardware, or firmware, or both.

13. A non-transitory computer readable medium having a computer readable program code embodied therein, the computer readable program code adapted to be executed to implement a method of determining the time of flight of ions in a sample, the method comprising:

providing a calibration sample comprising ions of different mass-to-charge ratios to a time-of-flight mass analyzer and acquiring data until an ion with a greatest time of flight is incident on an ion detector;

determining a peak width for each of the ion species after summing several time-of-flight measurements of the calibration sample to provide calibration data of peak width versus flight time;

determining a data acquisition time, the data acquisition time being a predetermined fraction of the greatest time of flight;

providing ions from a continuous beam of a sample to a time-of-flight mass analyzer at pulse intervals having a duration equal to the predetermined non-unity fraction of the greatest flight time;

measuring a peak width and a flight time value for each of the ion species in the sample after summing the data acquired during several pulse intervals;

correcting the measured flight time values according to a correlation of measured peak width values with the calibration data of peak width versus flight time; and converting the corrected flight time values into the mass-to-charge ratios.

14. A non-transitory computer readable medium as claimed in claim 13, further comprising interpolating calibration data between the flight times of the ion species in the calibration sample to determine approximate peak widths at flight times that were not measured in the calibration data, and comparing at least one of the measured peak widths from the sample data to a corresponding one of the interpolated peak widths from the calibration data.

15. A non-transitory computer readable medium as claimed in claim 13, further comprising extrapolating calibration data beyond the ions with the greatest and the smallest times of flight, and comparing at least one of the measured peak widths from the sample data to a corresponding one of the extrapolated peak widths from the calibration data.

16. A non-transitory computer readable medium as claimed in claim 13, wherein the providing of the ions is repeated over a data acquisition interval.

17. A non-transitory computer readable medium as claimed in claim 13, wherein the determining of the data acquisition time further comprises reducing the time interval between pulses until an uncertainty in a peak width measurement is greater than a precision required to distinguish between peak widths from the calibration data for flight times that differ by the pulsing interval.

18. A non-transitory computer readable medium as claimed in claim 13, wherein the determining of the data acquisition time further comprises:

providing a reference sample to acquire reference peaks; and reducing the duration of the pulse intervals until one or more of the reference peaks present cannot be identified due to overlapping peaks in a spectrum measured with the reduced duration.

19. A non-transitory computer readable medium as claimed in claim 13, further comprising:

measuring a background spectrum having peaks;

scaling the peaks of the background spectrum; and subtracting the scaled peaks from the sample data before the peak widths are determined.

20. A time-of-flight (TOF) mass spectrometer (MS) comprising the computer readable medium of claim 13 and comprising a memory and a processor, wherein the memory is configured to store the non-transitory computer readable medium, and the computer-readable code is executed on the processor.

* * * * *